US005857522A

United States Patent [19]

Bradfield et al.

[11] Patent Number: 5,857,522

[45] Date of Patent: Jan. 12, 1999

[54] FLUID HANDLING SYSTEM FOR USE IN DRILLING OF WELLBORES

[75] Inventors: David H. Bradfield, Wantage; David P. J. Cummins, Newbury; Philip J. Bridger, Rugby, all of United Kingdom

[73] Assignee: Baker Hughes Incorporated, Houston, Tex.

[21] Appl. No.: 642,828

[22] Filed: May 3, 1996

[51] Int. Cl.[6] ..... E21B 43/34

[52] U.S. Cl. ..... 166/267; 166/75.12

[58] Field of Search ..... 166/265, 267, 166/105.1, 75.12, 192

[56] References Cited

U.S. PATENT DOCUMENTS

| | | | |
|---|---|---|---|
| 4,398,603 | 8/1983 | Rodwell | 166/267 |
| 4,416,333 | 11/1983 | Mundhenk et al. | 166/267 X |
| 4,449,594 | 5/1984 | Sparks . | |
| 4,995,460 | 2/1991 | Strahan | 166/267 |
| 5,010,966 | 4/1991 | Stokley et al. . | |
| 5,082,492 | 1/1992 | Gallup et al. | 166/267 X |
| 5,149,344 | 9/1992 | Macy | 166/267 X |
| 5,249,635 | 10/1993 | King et al. . | |
| 5,335,728 | 8/1994 | Strahan | 166/267 |
| 5,411,105 | 5/1995 | Gray . | |
| 5,413,718 | 5/1995 | Gallup et al. | 166/267 X |
| 5,415,776 | 5/1995 | Homan . | |
| 5,586,836 | 12/1996 | Morrow | 166/267 X |

FOREIGN PATENT DOCUMENTS 0 047 347 3/1982 European Pat. Off. .

OTHER PUBLICATIONS

Arnold et al, "Surface Production Operations", vol. 1, 1986, pp. 123–12.

*Primary Examiner*—Frank Tsay
*Attorney, Agent, or Firm*—Madan & Morris, PLLC

[57] ABSTRACT

This invention provides a fluid-handling system for use in underbalanced drilling operations. The system includes a first vessel which acts as a four phase separator. The first vessel includes a first stage for separating solids. Oil and gas are separated at a second stage. A pressure sensor provides signals to a pressure controller, which modulates a gas flow valve coupled to the vessel for discharging gas from the first vessel. The pressure controller maintains the pressure in the first vessel at a predetermined value. An oil level sensor placed in the first vessel provides a signal to an oil level controller. The oil level controller modulates an oil flow valve coupled to the vessel to discharge oil from the first vessel into a second vessel. Water is discharged into a third vessel. Water from the third vessel is discharged via a water flow control valve, which is modulated by a level controller as a function of the water level in the third vessel. Any gas in the third vessel is discharged by modulating a gas control valve as a function of the pressure in the third vessel. In an alternative embodiment, a central control unit or circuit is utilized to control the operations of all the flow valves. During operations, a control unit maintains the pressure and the levels of the fluids in such vessels at their respective predetermined values according to programmed instructions.

27 Claims, 3 Drawing Sheets

FLUID HANDLING SYSTEM FOR USE IN DRILLING OF WELLBORES

BACKGROUND OF THE INVENTION

1. Field of the Invention

This invention relates generally to drilling of wellbores and more particularly to a fluid-handling system for use in underbalanced drilling of wellbores.

2. Background of the Art

In conventional drilling of wellbores for the production of hydrocarbons from subsurface formations, wellbores are drilled utilizing a rig. A fluid comprising water and suitable additive, usually referred to in the art as "mud," is injected under pressure through a tubing having a drill bit which is rotated to drill the wellbores. The pressure in the wellbore is maintained above the formation pressure to prevent blow-outs. The mud is circulated from the bottom of the drill bit to the surface. The circulating fluid reaching the surface comprises the fluid pumped downhole and drill cuttings. Since the fluid pressure in the wellbore is greater than the formation pressure, it causes the mud to penetrate into or invade the formations surrounding the wellbore. Such mud invasion reduces permeability around the wellbore and reduces accuracy of measurements-while-drilling devices commonly used during drilling of the wellbores. Such wellbore damage (also known as the skin damage or effect) may extend from a few centimeters to several meters from the wellbore. The skin damage results in a decrease in hydrocarbon productivity.

To address the above-noted problems, some wells are now drilled wherein the pressure of the circulating fluid in the wellbore is maintained below the formation pressure. This is achieved by maintaining a back pressure at the wellhead. Since the wellbore pressure is less than the formation pressure, fluids from the formation (oil, gas and water) comingle with the circulating mud. Thus, the fluid reaching the surface contains four phases: cuttings (solids), water, oil and gas. Such drilling systems require more complex fluid-handling systems at the surface. The prior art systems typically discharge the returning fluids ("wellstream") into a pressure vessel or separator at the surface to separate sludge (solids), water, oil and gas. The pressure in the vessel typically exceed 1000 psi. A number of manually controlled valves are utilized to maintain the desired pressure in the separator and to discharge the fluids from the pressure vessel. These prior art systems also utilize manually controlled emergency shut down valves to shut down the drilling operations. Additionally, these systems rely upon pressure measured at the wellhead to control the mud pressure downhole. In many cases this represents a great margin of error. These prior art fluid-handling systems require the use of high pressure vessels, which are (a) relatively expensive and less safe than low pressure vessels, (b) relatively inefficient, and (c) require several operators to control the fluid-handling system.

The present invention addresses the above-noted deficiencies of the prior art fluid-handling systems and provides a relatively low pressure fluid-handling system which utilizes remotely controlled fluid flow control devices and pressure control devices, along with other sensors to control the separation of the constituents of the wellstream. The present invention also provides means for controlling the wellbore pressure from the surface as a function of the downhole measured pressure.

SUMMARY OF THE INVENTION

This invention provides a fluid-handling system for use in underbalanced drilling operations. The system includes a first vessel which acts a four phase separator. The first vessel includes a first stage for separating solids. Oil and gas are separated at a second stage into separate reservoirs. A pressure sensor associated with the first vessel provides a signal to a pressure controller which modulates a gas flow valve coupled to the vessel for discharging gas from the first vessel. The pressure controller maintains the pressure in the first vessel at a predetermined value. An oil level sensor placed in the first vessel provides a signal to an oil level controller. The oil level controller modulates an oil flow valve coupled to the vessel to discharge oil from the first vessel into a second vessel. The oil level controller operates the oil flow valve so as to maintain the oil level in the first vessel at a predetermined level. Similarly, water (fluid that is substantially free of oil and solids) is discharged into a third vessel. Water form the third vessel is discharged via a water flow control valve, which is modulated by a level controller as a function of the water level in the third vessel. Any gas in the third vessel is discharged by modulating a gas control valve as a function of the pressure in the third vessel.

In an alternative embodiment, a central control unit or circuit is utilized to control the operations of all the flow valves. Signals from the pressure sensors and level sensors are fed to the control unit, which controls the operations of each of the flow control valves based on the signals received from the various sensor and in accordance with programmed instructions. During operations, the control unit maintains the pressure in each of the vessels at their respective predetermined values. The control unit also maintains the fluid levels in each of the vessels at their respective predetermined values.

Examples of the more important features of the invention have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DETAILED DESCRIPTION OF PREFERRED EMBODIMENTS

Figure 1A:
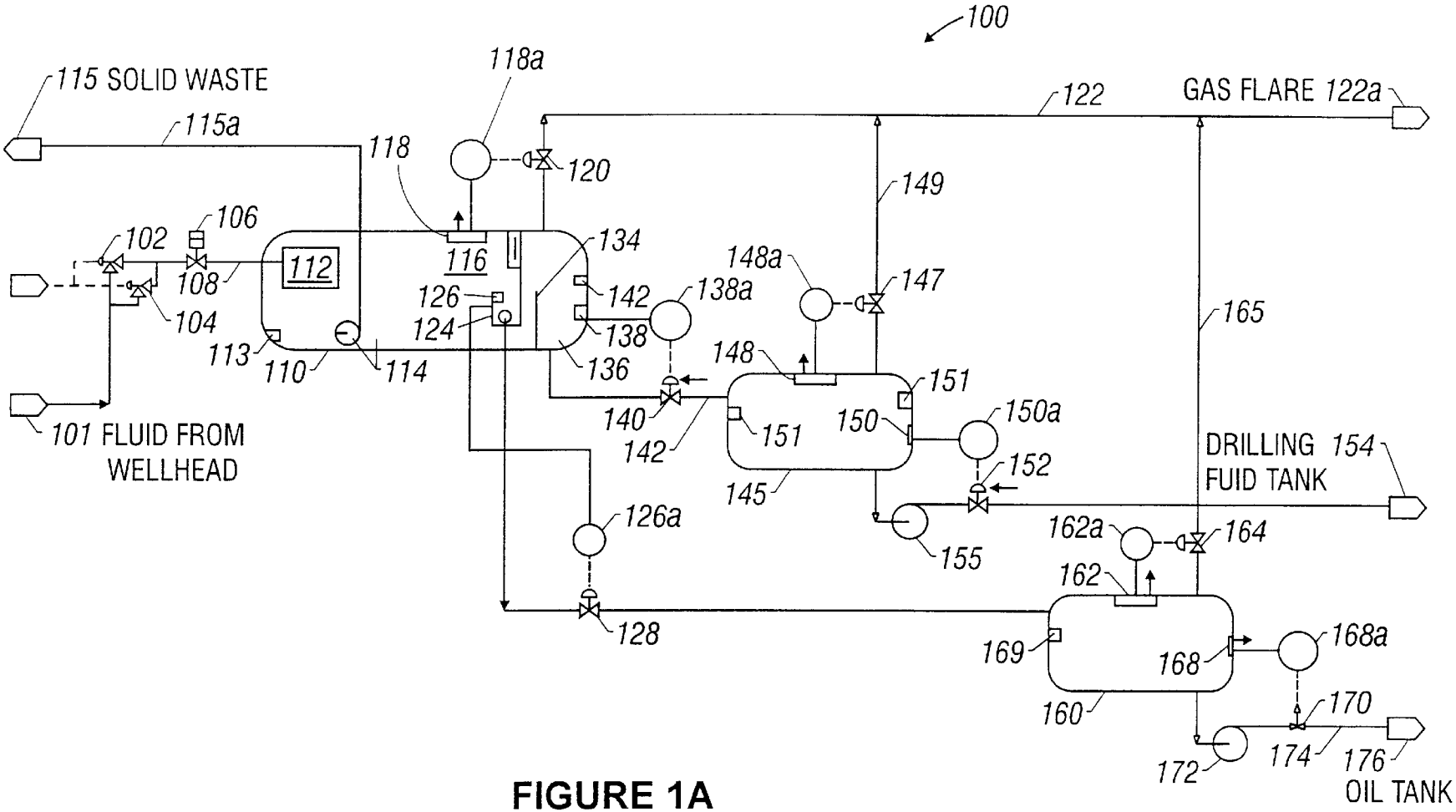
FIG. 1A shows a schematic of a fluid handling system according to the present invention.

FIG. 1A shows a schematic of a fluid-handling system 100 according to the present invention. During underbalanced drilling of a wellbore, a drilling fluid (also referred to as the "mud") is circulated through the wellbore to facilitate drilling of the wellbore. The fluid returning from the wellbore annulus (referred herein as the "wellstream") typically contains the drilling fluid originally injected into the wellbore, oil, water and gas from the formations, and drilled cuttings produced by the drilling of the wellbore.

In the system 100, the wellstream passes from a wellhead equipment 101 through a choke valve 102 which is duty-cycled at a predetermined rate. A second choke valve 104 remains on one hundred percent (100%) standby. The duty-cycled valve 102 is electrically controlled so as to maintain a predetermined back pressure. The wellstream then passes through an emergency shut-down valve ("ESD") 106 via a suitable line 108 into a four phase separator (primary separator) 110. The choke valve 102 creates a predetermined pressure drop between the wellhead equipment 110 and the primary vessel and discharges the wellstream into the primary vessel at a relatively low pressure, typically less than 100 psi. In some applications, it may be desirable to utilize more than one choke valve in series to obtain a sufficient pressure drop. Such choke valves are then preferably independently and remotely controlled as explained in more detail later.

Figure 1B:
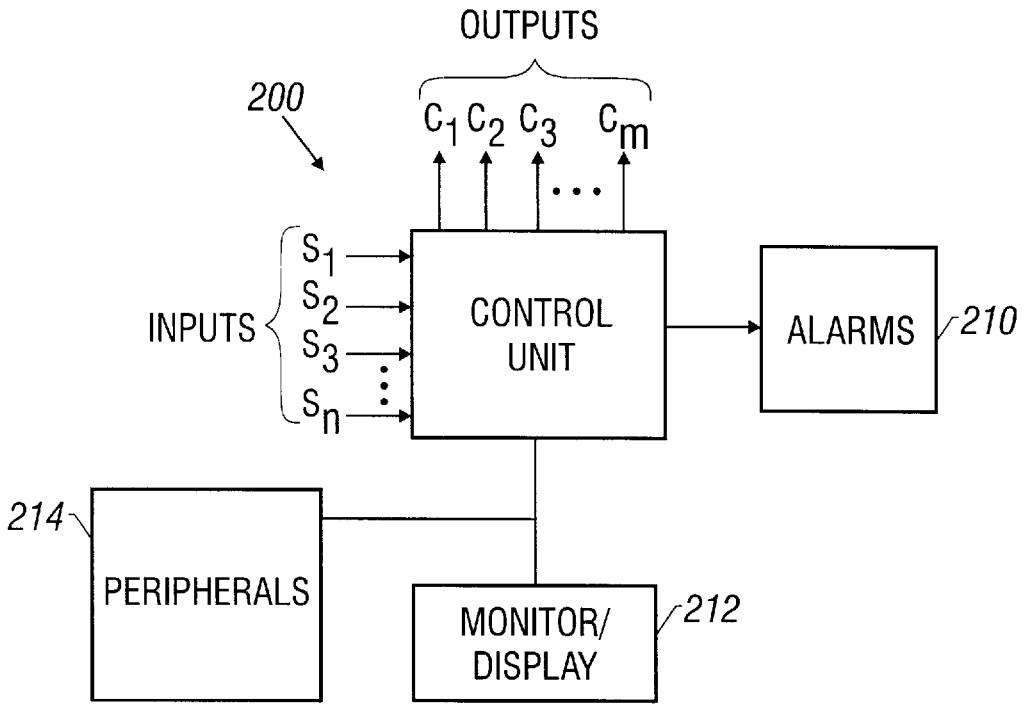
FIG. 1B shows a functional block diagram of a control system for use with the system of FIG. 1A for controlling the operation of the fluid handling system.

The primary separator 110 preferably is a four phase separator. The wellstream entering into the separator passes to a first stage of the separator 110. Solids (sludge), such as drilled cuttings, present in the wellstream are removed in the first stage by gravity forces that are aided by centrifugal action of an involute entry device 112 placed in the separator 110. Such separation devices are known in the art and, thus, are not described in detail. Any other suitable device also may be utilized to separate the solids from the wellstream. The solids being heavier than the remaining fluids collect at the bottom of the separator and are removed therefrom by a semi-submersible sludge pump 114. A sensor 113 detects the level of solids build-up in the vessel 110 and energizes the pump 114 to discharge the solids from the vessel 110 into a solids waste place 115 via a line 115*a*. The operation of the sludge pump 114 is preferably controlled by a control system placed at a remote location. FIG. 1B shows a control system 200 having a control unit or control circuit 201, which receives signals from a variety of sensors associated with the fluid-handling system 100, determines a number of operating parameters and controls the operation of the fluid-handling system 100 according to programmed instruction and models provided to the control unit 201. The operation of the control system 200 is described in more detail later.

The fluid that is substantially free of solids passes to a second stage, which is generally denoted herein by numeral 116. The second stage 116 essentially acts as a three phase separator to separate gas, oil and water present in the fluids entering the second stage. The gas leaves the separator 110 via a control valve 120 gas control device and line 122. The gas may be flared or utilized in any other manner. A pressure sensor 118 placed in the separator 110 and coupled to the control unit 201 is used to continually monitor the pressure in the separator 110. The control unit 201 adjusts a control valve 120 so as to maintain the pressure in the vessel 110 at a predetermined value or within a predetermined range. Alternatively, the a signal from the pressure sensor 118 may be provided to a pressure controller 118*a*, which in turn modulates the control valve 120 to maintain the pressure in the separator at a predetermined value. Both a high and a low pressure alarm signals are also generated from the pressure sensor signal. Alternatively, two pressure switches may be utilized, one such switch set to provide a high pressure signal and the other such switch set to provide a low pressure signal. The control unit 201 activates an alarm 210 (FIG. 1B) when the pressure in the separator is either above the high level or when it falls below the low level.

The control unit 201 may also be programmed to shut down the system 100 when the pressure in the separator is above a predetermined maximum level ("high-high") or below a predetermined minimum level ("low-low"). Alternatively, the system 100 may be shut down upon the activation of pressure switches placed in the separator, wherein one such switch is activated at the high-high pressure and another switch is activated at the low-low pressure. The high-high pressure trip protects against failure of the upstream choke valves 102 and 104, while the low-low trip protects the system against loss of containment within the vessel 110.

The oil contained in the fluid at the second stage 116 collects in a bucket 124 placed in the second stage 116 of the separator 110. A level sensor 126 associated with the bucket 124 is coupled to the control unit 201, which determines the level of the oil in the bucket 124. The control unit 201 controls a valve 128 to discharge the oil from the separator 110 into an oil surge tank 160. Alternatively, the level sensor 126 may provide a signal to a level controller 126*a*, which modulates the control valve 128 to control the oil flow from the bucket 124 into the oil surge tank 160. The oil level sensor signals also may be used to activate alarms 210 when the oil level is above a maximum level or below a minimum level.

In the second stage 116, fluid that is substantially free of oil (referred to herein as the "water" for convenience) flows under the oil bucket 124 in the area 116 and then over a weir 134 and collects into a water chamber or reservoir 136. A level sensor 138 is placed in the water reservoir 136 and is coupled to the control unit 201, which continually determines the water level in the reservoir 136. The control unit is programmed to control a valve 140 to discharge the water from the separator 110 into a water tank 145 via a line 142. Alternatively, the level sensor 128 may provide a signal to a level controller 138*a* which modulates the control valve 140 to discharge the water from the separator 110 into the water tank 145. Additionally, the liquid level in the main body of the separator is monitored by a level switch 142 which provides a signal when the liquid level in the main body of the separator 110 is above a maximum level, which signal initiates the emergency shut down. This emergency shut down prevents any liquid passing into the gas vent 11 or into any flare system used.

Any gas present in the water discharged into the water tank separates within the water tank 145. Such gas is discharged via a control valve 147 to flare. A pressure sensor 148 associated with the water tank 145 is utilized to control the control valve 147 to maintain a desired pressure in the water tank 145. The control valve 147 may be modulated by a pressure controller 148*a* in response to signals from the pressure sensor 148. Alternatively, the control valve 147 may be controlled by the control unit 201 in response to the signals from the pressure sensor 148. Alarms are activated when the pressure in the water tank 145 is above or below predetermined limits. Water level in the water tank 145 is monitored by a level sensor 150. A level controller 150*a* modulates a control valve 152 in response to the level sensor signals to maintain a desired liquid level in the water tank 145. Alternatively, control unit 201 may be utilized to control the valve 152 in response to the level sensor signals. The fluid level in the water tank 145 also is monitored by a level switch 151, which initiates an emergency shutdown of the system if the level inadvertently reaches a predetermined maximum level. A pump 155 passes the fluids from the water tank 145 to the control valve 152. The fluid leaving the valve 152 discharges via a line 153 into a drilling fluid tank 154.

Any gas present in the oil surge tank 160 separates within the oil surge tank 160. The separated gas is discharged via a control valve 164 and a line 165 to the gas line 122 to flare. A pressure sensor 162 associated with the oil surge tank 160 is utilized to control the control valve 164 in order to maintain a desired pressure in the oil surge tank 160. The control valve 164 may be modulated by a pressure controller 162*a* in response to signals from the pressure sensor 162. Alternatively, the operation of the control valve 164 may be controlled by the control unit 201 in response to the signals from the pressure sensor 162. Alarms 210 are activated when the pressure in the oil surge tank 160 is either above or below their respective predetermined limits. Oil level in the oil surge tank 160 is monitored by a level sensor 168. A level controller 168*a* modulates a control valve 170 in response to the level sensor signals to maintain a desired liquid level in the oil surge tank 160. Alternatively, the control unit 201 may be utilized to control the valve 170 in response to the signals from the level sensor 168. The liquid level in the oil surge tank 160 also is monitored by a level switch 169, which initiates an emergency shutdown of the system if the level inadvertently reaches a predetermined maximum level. A pump 172 passes the fluids from the oil surge tank 160 to the control valve 170. The fluid leaving the valve 170 discharges via a line 174 into a an oil tank or oil reservoir 176.

Still referring to FIGS. 1A and 1B, the control unit 201 may be placed at a suitable place in the field or in a control cabin having other control equipment for controlling the overall operation of the drilling rig used for drilling the wellbore. The control unit 201 is coupled to one or more monitors or display screens 212 for displaying various parameters relating to the fluid-handling system 100. Suitable data entry devices, such as touch-screens or keyboards are utilized to enter information and instructions into the control unit 201. The control unit 201 contains one or more data processing units, such as a computer, programs and models for operating the fluid-handling system 100.

In general, the control unit 201 receives signals from the various sensors described above and any other sensors associated with the fluid-handling system 100 or the drilling system. The control unit 201 determines or computes the values of a number of operating parameters of the fluid-handling system and controls the operation of the various devices based on such parameters according to the programs and models provided to the control unit 201. The ingoing or input lines $S_1$–$S_n$ connected to the control unit 201 indicate that the control unit 201 receives signals and inputs from various sources, including the sensors of the system 100. The outgoing or output lines $C_1$–$C_m$ are shown to indicate that the control unit 201 is coupled to the various devices in the system 201 for controlling the operations of such devices, including the control valves 102, 104, 120, 128 147, 152, 64, 168 and 170, and pumps 124, 155 and 170.

Figure 2:
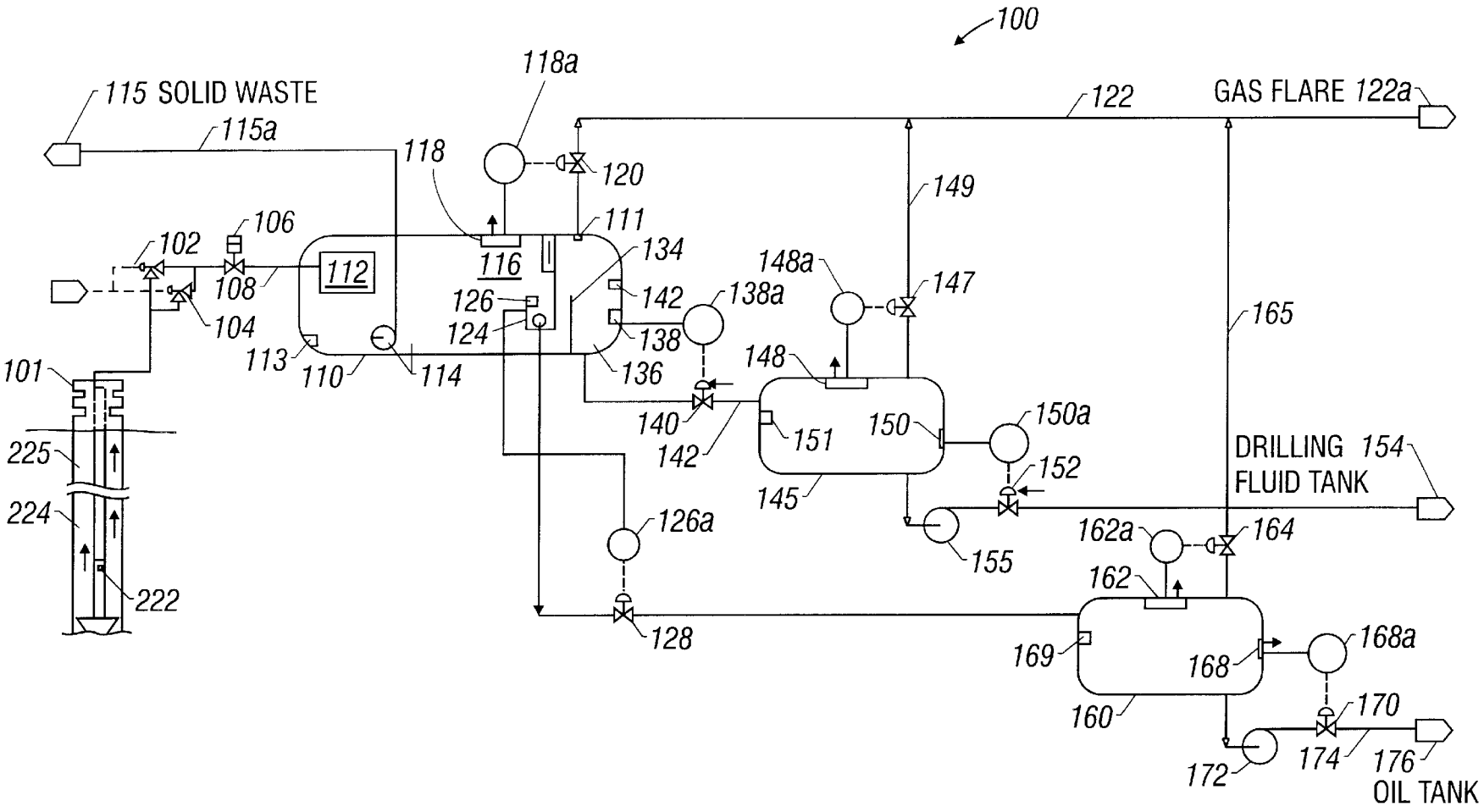
FIG. 2 shows the fluid handling system of FIG. 1A in conjunction with a schematic representation of a wellbore with a drilling assembly conveyed therein that is adapted for measuring the wellbore pressure during drilling of the wellbore operations.

Referring now to FIGS. 1A, 1B and 2, prior to the operation of the system 100, an operator stationed at the control unit 201, which is preferably placed at a safe distance from the fluid-handling system 100, enters desired control parameters, including the desired levels or ranges of the various parameters, such as the fluid levels and pressure levels. As the drilling starts, the control unit 201 starts to control the flow of the wellstream from the wellbore 225 by controlling the valves 102 and 104 so as to maintain a desired back pressure. The control unit 201 also controls the pressure in the separator 110, the fluid levels in the separator 110 and each of the tanks 145 and 160, the discharge of solids from the separator 110 and the discharge of the gases and fluids from the tanks 145 and 170.

As noted earlier, prior art systems control the wellbore pressure by maintaining the pressure at the surface at a desired value. Based on the depth of the wellbore and the types of fluids utilized during drilling of the wellbore, the actual downhole pressure can vary from the desired pressure by several hundred pounds. In order to accurately control the pressure in the wellbore, the present system is augmented with a pressure sensor 222 placed near the drill string 224 utilized for drilling the wellbore 225. During the drilling operations, the control unit 201 continually monitors the wellbore pressure from the sensor 222 and controls the fluid flow into the wellbore 225 by controlling the fluid control devices 230 placed on the surface so as to maintain the wellbore pressure at a predetermined value or within a predetermined range.

The above-described system requires substantially less manpower to operate in contrast to known fluid-handling systems utilized during underbalanced drilling of wellbores. The pressure in the separator 110 is maintained below 100 psi compared to known prior art systems, which typically operate at a pressure of more than 1000 psi. Low pressure operations lessen the costs associated with manufacture of separators. More importantly, the low pressure operations of the present system are inherently safer that the relatively high pressure operations of the prior art systems. The control of the wellhead equipment based on the downhole-measured pressure during the drilling operations provides for more accurate control of the pressure in the wellbore.

While the foregoing disclosure is directed to the preferred embodiments of the invention, various modifications will be apparent to those skilled in the art. It is intended that all variations within the scope and spirit of the appended claims be embraced by the foregoing disclosure.

What is claimed is:

1. A vessel for separating materials from a wellbore fluid, comprising:

(a) a first stage for separating solids contained in the fluid;

(b) a pressure sensor for determining the pressure in the vessel;

(c) a gas control device for discharging gas from the vessel; and (d) a pressure controller for automatically controlling the operation of the gas control device as a function of the pressure in the vessel.

2. The vessel as specified in claim 1, wherein the pressure controller modulates the gas control device to control the operation of the gas control device to discharge the gas from the vessel.

3. The vessel as specified in claim 2, wherein the gas control device is modulated so as to maintain the pressure in the vessel within a predetermined range.

4. The vessel as specified in claim 2, wherein the gas control device is modulated so as to maintain the pressure in the vessel at a predetermined value.

5. The vessel as specified in claim 2 further comprising a pressure switch for providing a signal when the pressure in the vessel is above a predetermined maximum value.

6. The vessel as specified in claim 5 further comprising a pressure switch for providing a signal when the pressure in the vessel is below a predetermined minimum value.

7. The vessel as specified in claim 5 further comprising a control circuit for preventing fluid entry into the vessel upon receiving a signal from the pressure switch.

8. A vessel for separating materials from a wellbore fluid, comprising:

(a) a first stage for separating solids contained in the fluid;

(b) a pressure sensor for determining pressure in the vessel;

(c) a second stage for separating oil and water into a separate reservoir;

(d) a separate level sensor associated with the water reservoir and the oil reservoir for respectively determining water level and oil level in their respective reservoirs; and (e) a control circuit, said control circuit receiving signals from the pressure sensor and each of the level sensors for controlling the pressure, oil level, and water level in the vessel.

9. The vessel as specified in claim 8 further comprising a pump for discharging solids from the vessel.

10. The vessel as specified in claim 8 further comprising a fluid flow control device associated with the vessel for discharging oil from the vessel.

11. The vessel as specified in claim 8 further comprising a first flow control device associated with the vessel for discharging oil from the vessel.

12. The vessel as specified in claim 11 further comprising a second flow control device associated with the vessel for discharging water from the vessel.

13. The vessel as specified in claim 12, wherein the control circuit controls the gas flow from the vessel so as to maintain the pressure in the vessel within a predetermined range.

14. The vessel as specified in claim 13, wherein the control circuit controls the discharge of the oil and water from the vessel so as to maintain the oil level and the water level in the vessel below their respective predetermined limits.

15. The vessel as specified in claim 13, wherein the control circuit controls the discharge of the oil and water by controlling a separate flow control valve associated with the oil and water.

16. A fluid-handling system for separating constituents of a wellstream, comprising:

(a) a first vessel having (i) a first stage for separating solids contained in the fluid, (ii) a second stage for separating oil and gas, (iii) a pressure sensor associated with the first vessel for determining the pressure in the first vessel, an oil level sensor for determining the level of the oil in the vessel and a water level sensor for determining the level of water in the first vessel, (iv) a pressure controller for automatically controlling the flow of gas from the first vessel by modulating a gas control valve to maintain the pressure in the vessel below a predetermined value;

(v) a first level controller for automatically controlling the flow of oil from the first vessel by modulating a flow control valve as a function of the oil level in the vessel to maintain the oil level in the vessel below a predetermined level;

(vi) a second level controller for automatically controlling the flow of water from the first vessel by modulating a second flow control valve as a function of the pressure in the vessel to maintain the water level in the vessel below a predetermined level;

(b) a second vessel for receiving oil from the first vessel, said second vessel having a pressure controller cooperating with a pressure sensor associated with the second vessel to discharge any gas contained in the second vessel, said second vessel also having a level controller cooperating with a level sensor to maintain the oil in the second vessel below a predetermined level; and (c) a third vessel for receiving fluid that is substantially free of oil from the first vessel, said third vessel having a pressure controller cooperating with a pressure sensor associated with the third vessel to discharge any gas contained in the third vessel, said third vessel also having a level controller cooperating with a level sensor to maintain the fluid in the third vessel below a predetermined level.

17. A method for separating solids, oil, gas and water from a relatively high pressure wellbore fluid, comprising:

(a) reducing the wellbore fluid pressure to a relatively low pressure;

(b) discharging the relatively low pressure fluid into a separator and removing solids from the wellbore fluid within the separator;

(c) controlling discharge of gas from the separator by a gas flow control device by a control unit so as to maintain the pressure in the separator below a predetermined value;

(d) separating oil and water within the separator;

(e) controlling discharge of oil from the separator through an oil flow device by the control unit so as to maintain the oil level in the separator below a predetermined value; and (f) controlling discharge of water from the separator through a water flow device by the control unit so as to maintain the water level in the separator below a predetermined value.

18. A fluid-handling system for separating constituents of a wellbore fluid that is at a relatively high pressure, comprising:

(a) a fluid flow control device for receiving the wellbore fluid at the relatively high pressure and discharging the received fluid at a relatively low pressure;

(b) a vessel for receiving the wellbore fluid from the fluid flow control device and for separating constituents of the wellbore fluid, said vessel having, (i) a first stage for separating solids contained in the fluid;

(ii) a pressure sensor for determining pressure in the vessel;

(iii) a second stage for separating oil and water into a separate reservoir;

(iv) a separate level sensor associated with the water reservoir and the oil reservoir for respectively determining water level and oil level in their respective reservoirs; and (c) a control circuit, said control circuit receiving signals from the pressure sensor and each of the level sensors for controlling the pressure, oil level, and water level in the vessel.

19. The apparatus as specified in claim 18, wherein the fluid flow control device is a choke valve.

20. The apparatus as specified in claim 18, wherein the relatively high pressure is greater than 1000 psi and the relatively low pressure is below 100 psi.

21. A method for separating constituents of a relatively high pressure wellbore fluid comprising:

(a) reducing the wellbore fluid pressure to a relatively low pressure;

(b) discharging the relatively low pressure fluid into a separator and separating solids from the fluid in said separator;

(c) determining pressure in the vessel;

(d) automatically discharging gas from the separator through a gas flow control device in response to the determined pressure in the vessel so as to maintain the pressure in the separator below a predetermined value.

22. The method of claim 21 wherein the discharging of the gas is done by modulating the gas flow control device.

23. The method of claim 21 further comprising controllably discharging oil from the separator to maintain the oil level in the separator below a predetermined level.

24. The method of claim 21 further comprising controllably discharging water from the separator to maintain the water level in the separator below a predetermined level.

25. A fluid-handling system for separating constituents of a wellstream, comprising:

(a) a first vessel having (i) a first stage for separating solids contained in the fluid, (ii) a second stage for separating oil and gas, (iii) a pressure sensor associated with the first vessel for determining the pressure in the first vessel;

(iv) a pressure controller for automatically controlling the flow of gas from the first vessel to maintain the pressure in the vessel below a predetermined value; and (b) a second vessel for receiving oil from the first vessel, said second vessel having a pressure controller cooperating with a pressure sensor associated with the second vessel to discharge any gas contained in the second vessel, said second vessel also having a level controller cooperating with a level sensor to maintain the oil in the second vessel below a predetermined level.

26. The fluid handling system of claim 25 further comprising a third vessel for receiving fluid that is substantially free of oil from the first vessel, said third vessel having a pressure controller cooperating with a pressure sensor associated with the third vessel to discharge any gas contained in the third vessel.

27. The fluid handling system of claim 26 further a level controller cooperating with a level sensor to maintain the fluid in the third vessel below a predetermined level.

* * * * *